US007646281B2

(12) United States Patent
Diekmann et al.

(10) Patent No.: US 7,646,281 B2
(45) Date of Patent: Jan. 12, 2010

(54) SNAP-TOGETHER CHOKE AND TRANSFORMER ASSEMBLY FOR AN ELECTRIC ARC WELDER

(75) Inventors: Craig L. Diekmann, Mentor, OH (US); Lawrence A. Boehnlein, Chardon, OH (US); Larry B. Solski, Avon, OH (US); Dale L. Bilczo, Rocky River, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 622 days.

(21) Appl. No.: 11/036,455

(22) Filed: Jan. 14, 2005

(65) Prior Publication Data

US 2006/0158303 A1 Jul. 20, 2006

(51) Int. Cl.
*H01F 27/24* (2006.01)

(52) U.S. Cl. ..... 336/234

(58) Field of Classification Search ..... 336/234
See application file for complete search history.

(56) References Cited

U.S. PATENT DOCUMENTS

| | | | | | |
|---|---|---|---|---|---|
| 2,509,187 | A | * | 5/1950 | Feinberg | 336/165 |
| 2,699,532 | A | * | 1/1955 | Bussing | 336/100 |
| 2,712,084 | A | * | 6/1955 | Bridenbaugh | 310/216 |
| 2,794,218 | A | * | 6/1957 | Ramsay | 52/204.597 |
| 2,883,590 | A | * | 4/1959 | Axman | 335/243 |
| 3,371,263 | A | * | 2/1968 | Ostreicher et al. | 363/100 |
| 3,443,137 | A | | 5/1969 | McElroy | |
| 3,587,020 | A | | 6/1971 | Waasner | |
| 3,793,129 | A | | 2/1974 | Doggart, et al. | |
| 3,983,621 | A | * | 10/1976 | Donahoo | 29/596 |
| 4,220,883 | A | * | 9/1980 | Padoan | 310/216 |
| 4,711,019 | A | | 12/1987 | Albeck et al. | |
| 4,827,237 | A | | 5/1989 | Blackburn | |
| 4,897,916 | A | | 2/1990 | Blackburn | |
| 5,047,745 | A | | 9/1991 | Marriott et al. | |
| 5,075,150 | A | * | 12/1991 | Webb et al. | 428/162 |
| 5,619,086 | A | | 4/1997 | Steiner | |
| 5,671,526 | A | | 9/1997 | Merlano | |
| 6,031,441 | A | | 2/2000 | Yen | |
| 6,658,721 | B2 | | 12/2003 | Kazama et al. | |
| 6,930,580 | B2 | * | 8/2005 | Clark et al. | 336/178 |

FOREIGN PATENT DOCUMENTS

| | | | |
|---|---|---|---|
| JP | 63076309 A | * | 4/1988 |
| JP | 08064428 A | * | 3/1996 |

* cited by examiner

*Primary Examiner*—Elvin G Enad
*Assistant Examiner*—Joselito Baisa
(74) *Attorney, Agent, or Firm*—Bret A. Hrivnak; Hahn Loeser + Parks LLP

(57) ABSTRACT

An apparatus for an electric arc welder comprising a first electromagnetic device including a first core assembly, wherein the first core assembly has a first stack of laminations which are press-fitted or snapped together into interlocking engagement with a complementary second stack of laminations so as to form two flux paths through the first core assembly, each of which passes through a center portion of the first core assembly; a second electromagnetic device, such as a transformer, including a second core assembly, wherein the second core assembly has a first stack of laminations which are press-fitted or snapped together into interlocking engagement with a complementary second stack of laminations so as to form two flux paths through the second core assembly, each of which passes through a center portion of the second core assembly; and wherein the two core assemblies of the electromagnetic devices are press-fitted or snapped together into interlocking engagement with each other.

15 Claims, 13 Drawing Sheets

SNAP-TOGETHER CHOKE AND TRANSFORMER ASSEMBLY FOR AN ELECTRIC ARC WELDER

FIELD OF THE INVENTION

The present invention relates generally to electromagnetic devices such as chokes and transformers and deals more particularly with an improved choke and transformer assembly that is press fitted or snapped together and may be used with electric arc welders, and it will be described with particular reference thereto. However, it is to be appreciated that the present invention is also amenable to other like applications.

BACKGROUND

In the field of electric arc welding, it is common practice to use electromagnetic devices such as chokes and transformers in power supplies. For example, as described in Clark et al., U.S. Pat. No. 5,819,934, incorporated by reference herein, a power source, such as a single phase line voltage, may be directed through a transformer to a rectifier in a DC electric arc welder. The output circuit normally includes a capacitor in parallel across the electrode and the workpiece, with a relatively small inductance for charging the capacitor as a rectifier or power supply provides DC current. This inductance removes the ripple from the welding current. And, in series with the arc gap of the welder, there is generally provided a choke capable of handling high currents and used to control current flow for stabilizing the arc.

A transformer (or choke) generally consists of one or more coils (windings) of conducting wire, wound on a former (bobbin) that surrounds the center limb (or sometimes all limbs) of a circuit of magnetic material (core). The winding wires are insulated, and the core is made from thin sheet steel plates known as laminations (this reduces "eddy current" losses). The assembly is typically held together by clamps, which are held in place by long screws that are insulated from the rest of the structure (again, to limit eddy currents). The winding wires are either made off to terminals mounted on the clamps or the wire may leave the coil by leads.

In particular, chokes and transformers commonly have cores made up of individual laminations which may take the form of a butted stack or an interleaved stack. A variety of ways have been used to hold the laminations together to make a core for the device. They have been bolted together. They have been welded together. They have been adhered together. They have been enclosed within a retaining frame. But all these methods are costly because they involve additional components and/or add to the time and number of operations needed to assemble the core. It is desirable, therefore, to improve the ease of assembly by simply press fitting or "snapping together" the main components, while maintaining or improving upon the structural integrity and performance of the choke and transformer cores.

BRIEF DESCRIPTION

In accordance with an aspect of the present invention, there is provided an apparatus for an electric arc welder. The apparatus comprises a first electromagnetic device including a first core assembly, wherein the first core assembly has a first stack of laminations which are press-fitted or "snapped" together into interlocking engagement with a complementary second stack of laminations so as to form two flux paths through the first core assembly, each of which passes through a center portion of the first core assembly; a second electromagnetic device, such as a transformer, including a second core assembly, wherein the second core assembly has a first stack of laminations which are press-fitted or "snapped" together into interlocking engagement with a complementary second stack of laminations so as to form two flux paths through the second core assembly, each of which passes through a center portion of the second core assembly; and wherein the two core assemblies of the electromagnetic devices are press-fitted or "snapped" into interlocking engagement with each other.

In one embodiment, the first electromagnetic device is a choke and the second electromagnetic device is a transformer. The lamination stacks comprise generally E-shaped laminations to form E-E choke and transformer cores, although E-I choke and transformer cores may be utilized in the present invention. Each stack of E-shaped laminations generally has a base portion extending between a first side edge and a second side edges and extending from each base portion is a first outer leg, a center leg and a second outer leg. The first and second outer legs of each stack of laminations have end configurations which are mirror images of each other and facilitate an intermitting engagement of the two lamination stacks, each of the end configurations including an outer edge surfaces, an inner edge surface, a camming surface, and a notch.

The apparatus generally includes a first bobbin that is mountable on the center portion of the first core assembly, the primary winding of the first core assembly wound about the first bobbin, a second bobbin that is mountable on the center portion of the second core assembly, the primary winding of the second core assembly wound about the first bobbin, and a secondary winding about the second bobbin.

Further, two outer portions and the center portion of the first core assembly make up the flux paths through the first core assembly, and the center portion of the first core assembly has a cross-sectional area that is substantially twice the cross-sectional area of either of the outer core portions.

The first stack of laminations in the first core assembly may include mounting means in each of the outside corners, where each mounting means comprises a generally L-shaped cutout having a side wall and a bottom wall and each side wall includes a barb for biting into a plastic housing and securing the apparatus in the housing. Likewise, the second stack of laminations in the second core assembly would include mounting means in each of the outside corners, where each mounting means comprises a barb for biting into a plastic housing and securing the apparatus in the housing.

Depressed areas are provided in the lamination stacks, rectangular in shape, so as to provide a recess on one side of each lamination and a protuberance on the other side of each lamination to facilitate interlocking engagement of the laminations when they are press fitted against each other.

The pieces of lamination in each of the mating stacks of laminations are punched from the same area in a sheet of lamination blank material and the lamination pieces in one stack are arranged upside down relative to the pieces in the other stack.

Thus, the choke and transformer assembly of the present invention differs from previously proposed laminations, lamination stacks and core assemblies by providing an end formation on one outer leg of the "E" that is a mirror image of an end formation on the other outer leg of the E-shaped lamination, with each such end formation including an outer surface, an inner surface and a camming surface adapted to engage and mate with a complimentary "E" shaped lamination. The choke and the transformer are adapted to "snap together" to form a single assembly that can be mounted in a housing made of plastic or a similar material.

Thus, the advantages of the choke and transformer assembly of the present invention include a simple design, fast assembly, no welding being needed, and consistent inductance.

DETAILED DESCRIPTION

Figure 1:
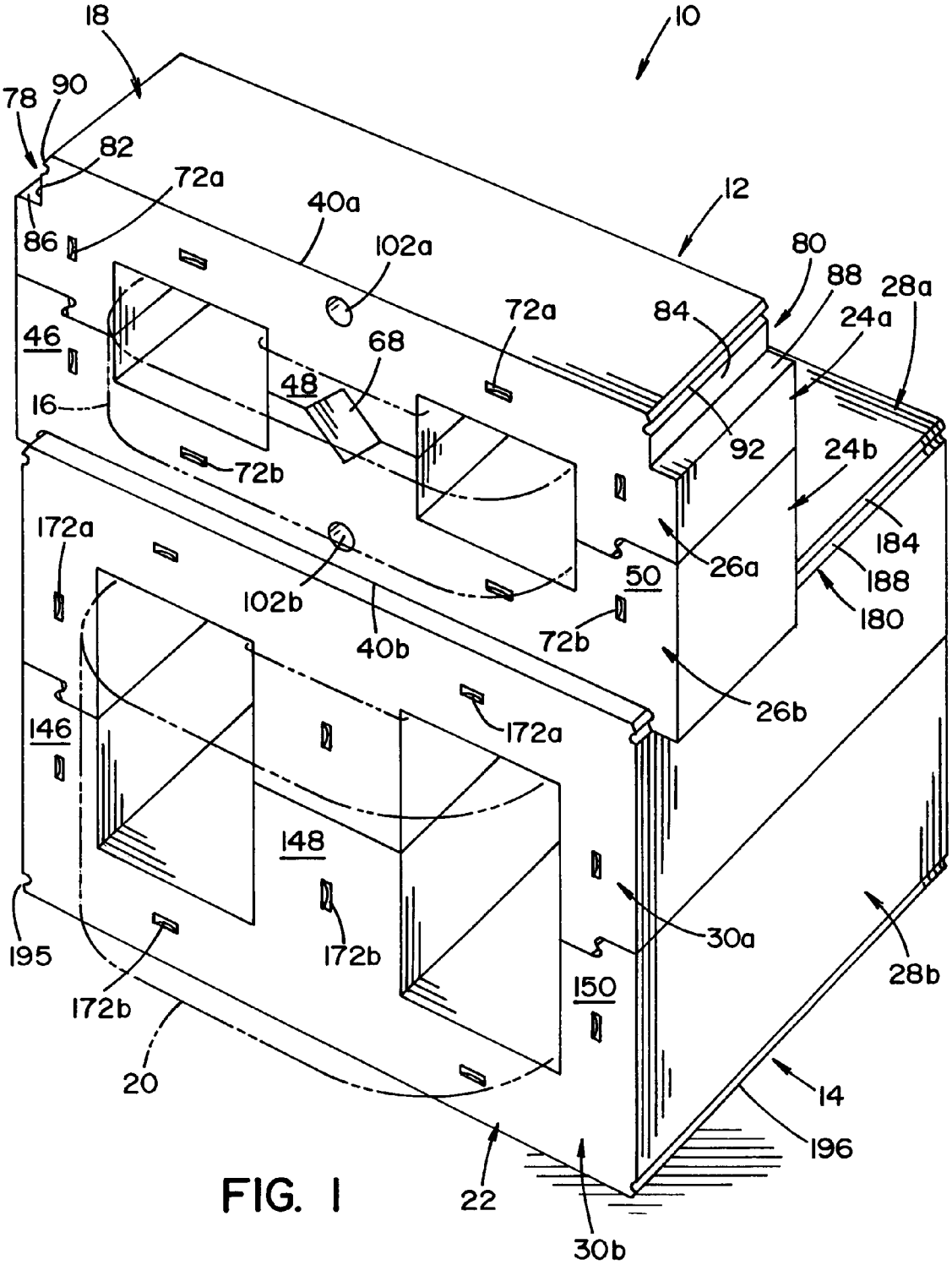
FIG. 1 is a perspective view of one embodiment of a choke and transformer assembly according to the present invention.
Figure 2:
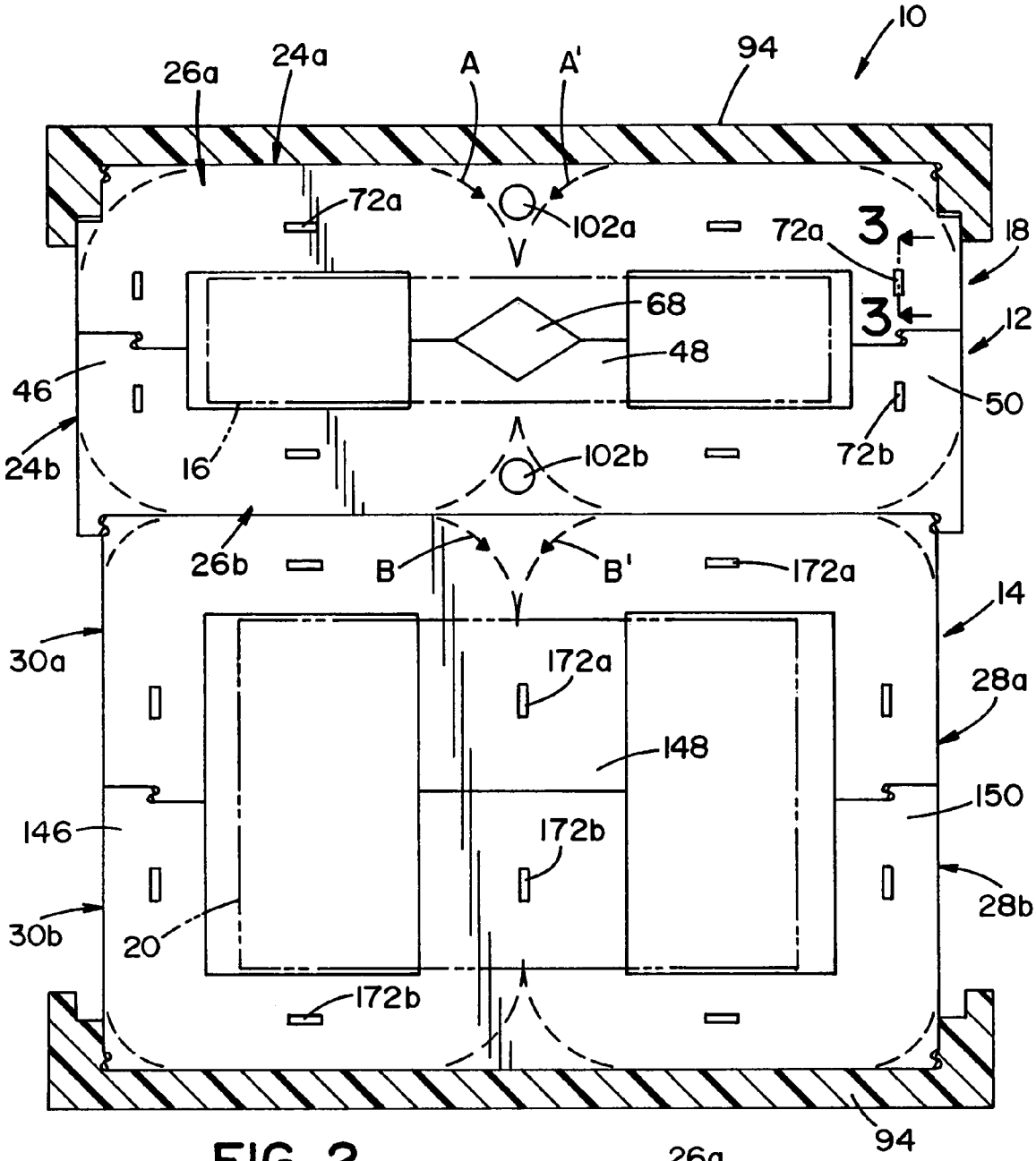
FIG. 2 is a front view of the choke and transformer assembly in FIG. 1 as mounted in a plastic housing.

Referring now to the drawings wherein the showings are for the purpose of illustrating the preferred embodiments only and not for the purpose of limiting the same, with like numerals being used for like and corresponding parts of the various drawings, FIGS. 1 and 2 illustrate a choke and transformer assembly 10 comprising a choke 12 and a transformer 14 constructed according to the teachings of the present invention. The choke 12 includes a coil 16 (shown in phantom lines) and a choke core assembly 18. The transformer 14 includes a coil 20 (shown in phantom lines) and a transformer core assembly 22. In this embodiment, the core assemblies 18 and 22 generally feature a "double-E" or "E-E" type structure, although it is to be appreciated that other known structures may be used, such as E-I structures. Thus, the choke core assembly 18 is made up of an upper stack 24*a* of E-shaped laminations 26*a*, which are press-fitted into interlocking engagement with a complementary lower stack 24*b* of E-shaped laminations 26*b*, (i.e., they are snapped together), in accordance with the teachings of the present invention. Likewise, the transformer core assembly 22 is made up of an upper stack 28*a* of E-shaped laminations 30*a*, which are press-fitted into interlocking engagement with a complementary lower stack 28*b* of E-shaped laminations 30*b* (i.e., snapped together). The choke 12 is press-fitted into interlocking engagement with the transformer 14 (i.e., snapped together) to form the choke and transformer assembly 10.

Figure 4:
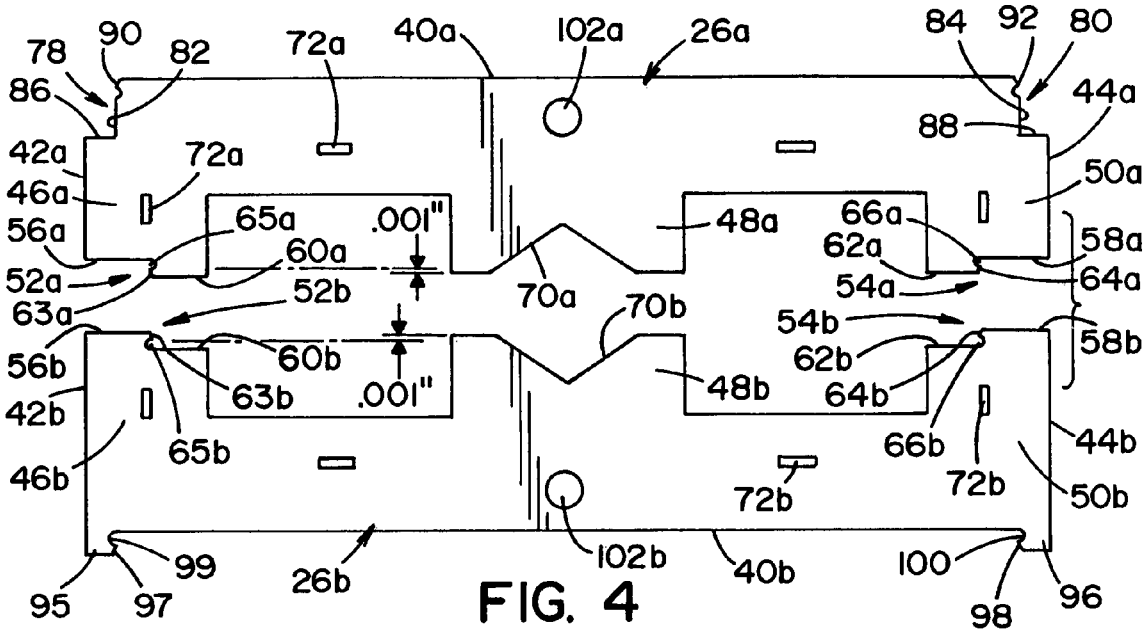
FIG. 4 is a front view, exploded, of the choke core of the assembly in FIG. 1.

As shown in FIG. 4, each "E" lamination 26*a* in the upper stack 24*a* has a base portion 40*a* extending between a first side edge 42*a* and a second side edge 44*a*. Extending from the base portion 40*a* is a first outer leg 46*a*, a center leg 48*a*, and a second outer leg 50*a*. As shown, the first and second outer legs 46*a* and 50*a* have end configurations 52*a* and 54*a*, which are mirror images of each other and facilitate an interfitting engagement of the upper and lower lamination stacks 24*a*, 24*b*. The end configurations 52*a*, 54*a* include outer edge surfaces 56*a*, 58*a*, inner edge surfaces 60*a*, 62*a*, camming surfaces 63*a*, 64*a*, and notches 65*a*, 66*a*. In this embodiment, the camming surfaces 63*a*, 64*a* are flat and inclined outwardly; however, it is to be appreciated that other configurations may be utilized, such as curved camming surfaces.

DC generally flows in the windings of the choke 12. The effect is that the DC creates a magnetomotive force that is unidirectional, and this reduces the maximum AC signal that can be carried before saturation in one direction. Therefore, to combat this, chokes subject to DC in the windings utilize an air gap in the core, so that it is no longer a complete magnetic circuit, but is instead broken by the gap. As shown, a diamond-shaped symmetrical air gap 68 is provided with the abutting edge portions of the center legs 48*a*, 48*b* touching each other to define the intermediate air gap. The small air gap portions gradually increase to a large gap portion. The air gap 68 is larger at the apex or center and decreases toward both edges of the core. The advantage of this diamond-shaped air gap 68 is that it provides a generally straight line, inversely proportional relationship between current and inductance, where the relationship is optimum for electric arc welding. Thus, the center leg 48*a* has a V-shaped cut-out 70*a*, which represents the top half of the air gap 68.

Figure 3:
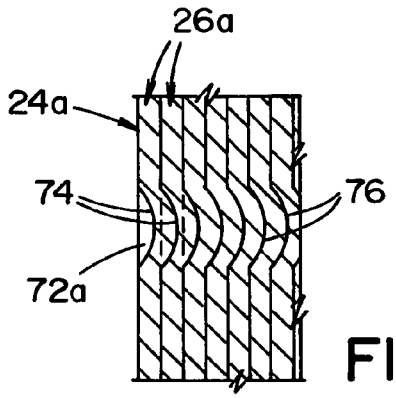
FIG. 3 is a partial cross-sectional view of a stack of laminations taken along the line 3-3 of FIG. 2.

For the purpose of facilitating the flat side to flat side joiner of the upper "E" laminations 26*a*, any number of metal displacements 72*a* are formed in each upper lamination 26*a* to form a rectangular depression or recess 74 on one side and a protuberance 76 on the other side, as shown in FIG. 3. In this embodiment, the metal displacements 72*a* are rectangular and four such displacements 72*a* are formed in the lamination 26*a*. It is to be understood, however, that the metal displacements 72*a* may be any other suitable shape, such as circular, and/or formed elsewhere on the upper lamination 26*a*. Each metal displacement 72*a* is formed by displacing part of the material in the upper lamination 26*a* such that the recess 74 is formed on one side opposite the protuberance 76 on the other side.

In this embodiment, the upper "E" laminations 26*a* include mounting means 78, 80 in the outside corners. The mounting means 78, 80 comprise generally L-shaped cut-outs having side walls 82, 84 and bottom walls 86, 88. The side walls 82, 84 feature barbs 90, 92 to assist in mounting and securing the choke and transformer assembly 10 in a housing 94 made of plastic or other suitable material. The barbs 90, 92 are adapted to "bite into" the plastic housing 94 while mounting the choke and transformer assembly 10. It is to be appreciated, however, that the upper laminations 26*a* may include different types of mounting means or no mounting means at all, depending upon how and where the choke and transformer assembly 10 is to be mounted.

The lower "E" laminations 26*b* are substantially similar to the upper "E" laminations 26*a*. That is, each lower "E" lamination 26*b* includes a base portion 40*b* extending between a first side edge 42*b* and a second side edge 44*b* of the "E" formation. Extending from the base portion 40*b* are three legs: a first outer leg 46*b*, a center leg 48*b*, and a second outer leg 50*b*. The first and second outer legs 46*b* and 50*b* have end configurations 52*b* and 54*b*, which are mirror images of each other. The end configurations 52*b* and 54*b* include outer edge surfaces 56*b*, 58*b*, inner edge surfaces 60*b*, 62*b*, camming surfaces 63*b*, 64*b*, and notches 65*b*, 66*b*. Additionally, a number of metal displacements 72*b* are formed in each lower lamination 26*b* for flat side to flat side joiner of laminations.

In this embodiment, the "E" laminations 26*b* include tabs 95, 96 in the outside corners for connecting the choke 12 to the transformer 14. The tabs 95, 96 include generally flat camming surfaces 97, 98 and notches 99, 100.

The base portions 40*a*, 40*b* of the laminations may include one or more holes 102*a*, 102*b*, respectively, which are used during the manufacturing process to help move the lamination sheet. (See FIG. 8 and description below.)

Figure 5:
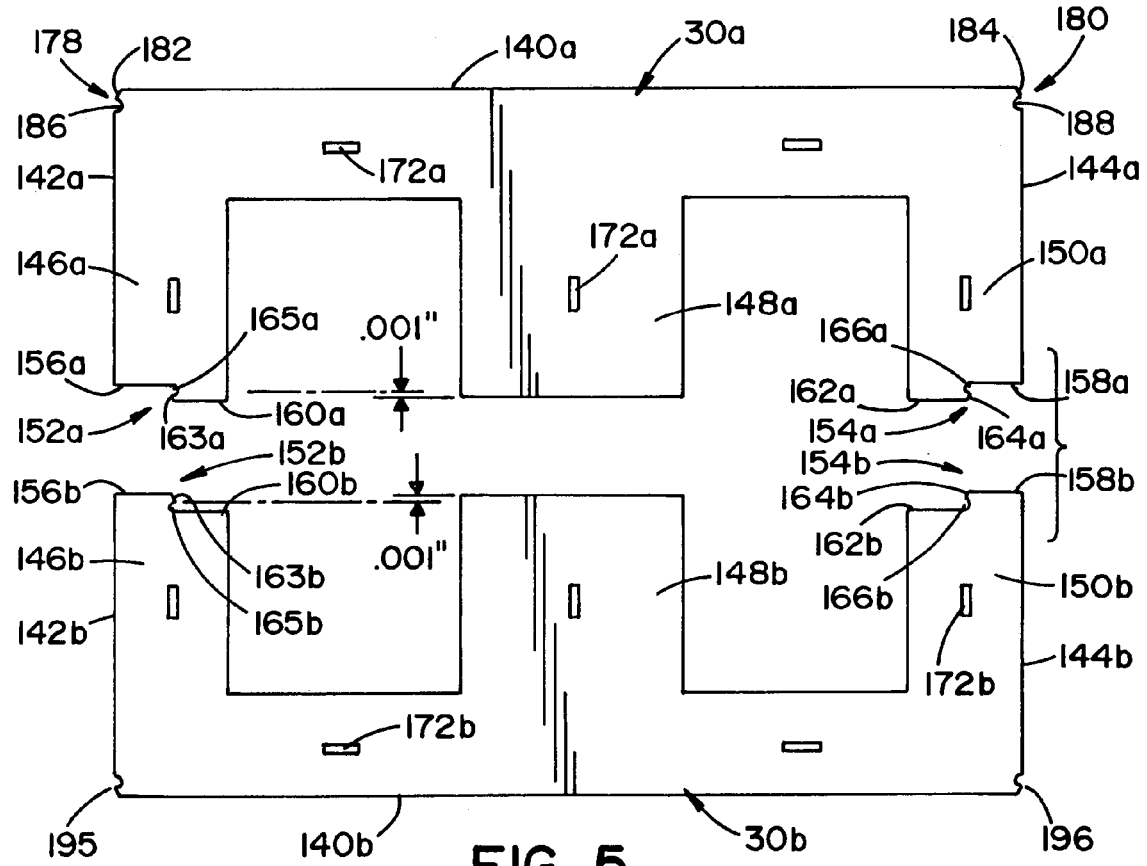
FIG. 5 is a front view, exploded, of the transformer core of the assembly in FIG. 1.

The structures of the transformer laminations 30*a*, 30*b* are similar to the choke laminations 26*a*, 26*b* described above. Thus, as shown in FIG. 5, the laminations 30*a*, 30*b* have base portions 140*a*, 140*b* extending between first side edges 142*a*, 142*b* and second side edges 144*a*, 144*b*. Extending from the base portions 140*a*, 140*b* are first outer legs 146*a*, 146*b*, center legs 148*a*, 148*b*, and second outer legs 150*a*, 150*b*.

In this embodiment, the first and second outer legs 146*a* and 150*a* of the upper laminations 30*a* have end configurations 152*a* and 154*a*, which are mirror images of each other and facilitate an interfitting engagement of the two lamination stacks 28*a*, 28*b*. The end configurations 152*a* and 154*a* include outer edge surfaces 156*a*, 158*a*, inner edge surfaces 160*a*, 162*a*, camming surfaces 163*a*, 164*a*, and notches 165*a*, 166*a*. Likewise, the first and second outer legs 146*b* and 150*b* of the lower laminations 30*b* have end formations 152*b* and 154*b*, which are mirror images of each other. The end configurations 152*b* and 154*b* include outer edge surfaces 156*b*, 158*b*, inner edge surfaces 160*b*, 162*b*, camming surfaces 163*b*, 164*b*, and notches 165*b*, 166*b*. To permit flat side to flat side joinder of the "E" laminations 30*a*, 30*b*, a number of metal displacements 172*a*, 172*b* are formed directly in the laminations.

In this embodiment, the upper laminations 30*a* include connecting means 178, 180 in the outside corners for connecting the choke 12 to the transformer 14. In this embodiment, the mounting means 178, 180 include generally flat camming surfaces 182, 184 and notches 186, 188.

It is to be appreciated that the lower "E" laminations 30*b* may also include barbs 195, 196 in the outside corners to facilitate mounting and securing the choke and transformer assembly 14 in the plastic housing 94.

When press-fitted or "snapped" together, the upper and lower lamination stacks 24*a*, 24*b* form the choke core 18. Specifically, the first outer legs 46*a*, 46*b* contact each other to form one outer portion (generally referred to herein as 46), the center legs 48*a*, 48*b* contact each other to form a center portion (generally referred to herein as 48) and the second outer legs 50*a*, 50*b* contact each other to form a second outer portion (generally referred to herein as 50). In the illustrated embodiment, the center portion 48 is thicker (or wider) than the outer portions 46, 50, although any desired width or thickness of the center leg portion can be provided.

In this embodiment, the center portion 48 of the choke core 18 is pre-loaded. That is, the center legs 48*a*, 48*b* are approximately 0.001" longer than the first outer legs 46*a*, 46*b* and the second outer legs 50*a*, 50*b*, as best seen in FIG. 4. Likewise, the center portion 148 of the transformer core 22 is pre-loaded. Thus, the center legs 148*a*, 148*b* are approximately 0.001" longer than the first outer legs 146*a*, 146*b* and the second outer legs 150*a*, 150*b* as best seen in FIG. 5. Pre-loading helps make a tighter fit when the lamination stacks are assembled together.

Figure 6A:
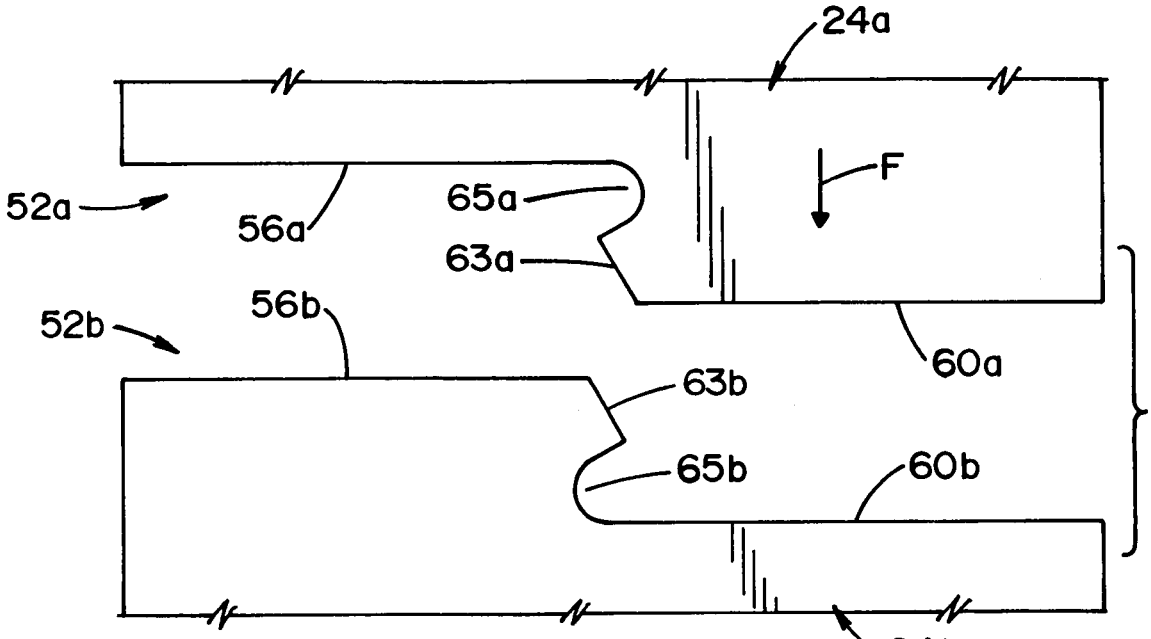
FIGS. 6A to 6C illustrate a detailed view of a method of assembling stacks of laminations together.
Figure 6B:
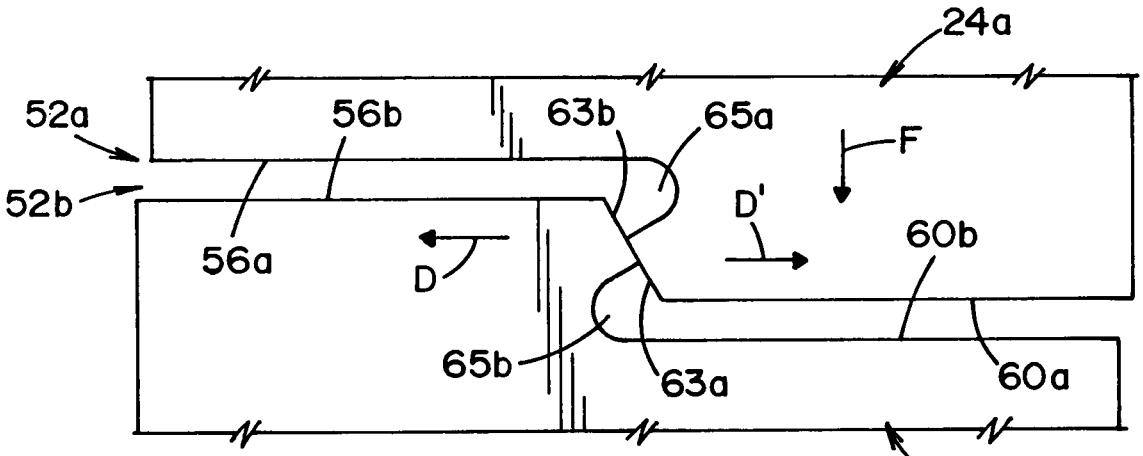
Figure 6C:
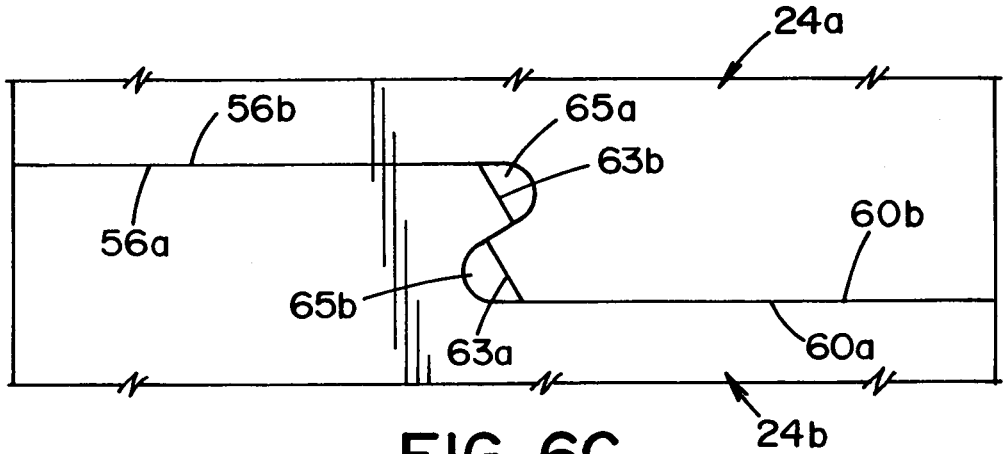

Reference is now made to FIGS. 6A to 6C, which show a method of assembling the stacks of laminations 24*a*, 24*b*. By way of example, the connection of the complementary end configurations 52*a* and 52*b* are shown. Thus, as a downward force F is exerted on the upper stack 24*a*, the camming surfaces 63*a*, 63*b* are forced together. As a result of the camming action between the two surfaces 63*a*, 63*b*, the lamination stacks 24*a*, 24*b* move slightly in opposing directions D, D'. When the opposing surfaces 60*a*, 60*b* and 56*a*, 56*b* meet, the lamination stacks 24*a*, 24*b* are locked in place. The camming action causes the lamination stacks 24*a*, 24*b* to mechanically engage each other in an interference fit, which locks them tightly together and minimizes vibrations in the laminations. The lamination stacks 24*a*, 24*b* formed in this manner and the resulting choke core assembly 18 formed are very rigid with good metal-to-metal contact and low reluctance. The lamination stacks 28*a*, 28*b* of the transformer core assembly 22 are assembled in a similar fashion.

Figure 7A:
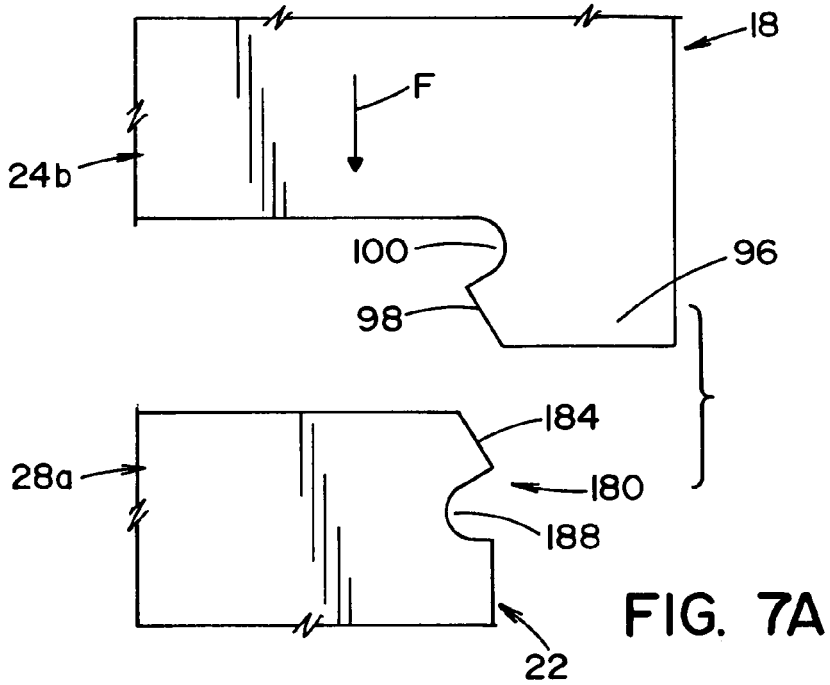
FIGS. 7A to 7C illustrate a detailed view of a method of assembling two cores together.
Figure 7B:
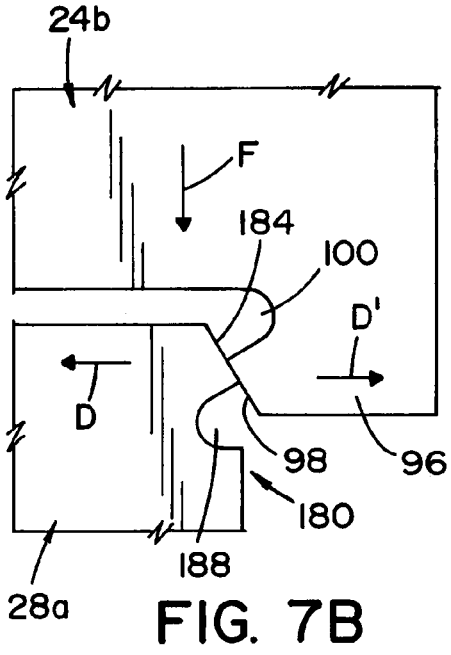
Figure 7C:
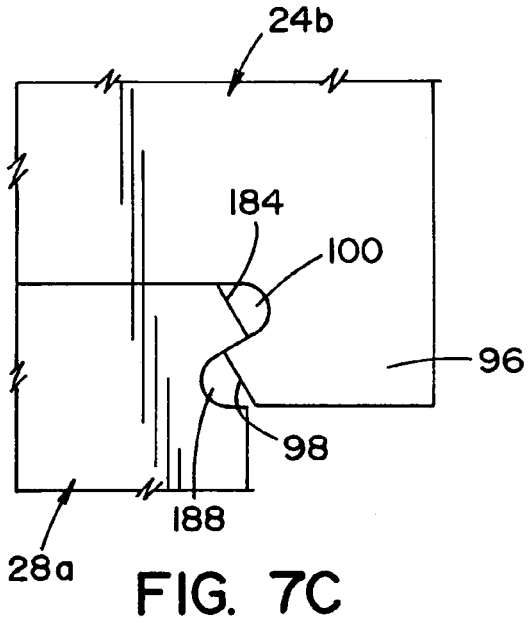

Reference is now made to FIGS. 7A to 7C, which illustrate a method of connecting the choke and transformer core assemblies 18, 22. By way of example, the connection of the complementary tab 96 and connecting means 180 is shown. Thus, as a downward force F is exerted, the camming surface 98 of the tab 96 is forced against the camming surface 184 of the mounting means 180. As a result of the camming action between the two camming surfaces 98, 184, the lamination stacks 24*b*, 28*a* move slightly in opposing directions D, D'. When the bottom portion of the choke lamination stack 24*b* and the top of the transformer lamination stack 28*a* meet, the stacks are locked in place. The camming action causes the stacks 24*b*, 28*a* to mechanically engage each other in an interference fit, which locks them tightly together.

The coil windings of the choke 12 are located about the center section 48 of the choke core 18, while the primary and secondary windings of the transformer 14 are located about the center section 148 of the transformer core 22. However, to simplify the winding of the transformer and/or the choke coils, a bobbin (not shown) may be used which fits over the center portion of each core. Prior to locating each bobbin (or otherwise insulated coil) on the center portions of the transformer and or the choke, the coils of the transformer and/or the choke are wound on the bobbin(s). The conductors (magnet wire and/or ribbon style) of the choke and transformer windings are shown only in phantom lines. Those skilled in the art will recognize that in each of FIGS. 1 and 2, the windings of the choke and transformer may be wound about the bobbin(s), and ordinarily would be viewable from the perspective of these figures. However, a bobbin is not a requirement for this assembly to work. For example, there may be no bobbin for the choke, as the coil for the choke may be insulated after winding.

When the cores are assembled as shown in FIG. 2, the primary and secondary windings have flux paths which coincide within the center portion of each core. This is demonstrated by the schematic cross-sectional front view of the choke and transformer assembly in FIG. 2. As shown, the magnetic coupling between the two windings is provided by the flux paths for each winding passing through the center portion of the core. For example, the flux path for the primary winding may be that indicated by the dashed line A, while the flux path for the secondary winding may be that indicated by the dashed line A', in the choke core 18 (although those skilled in the art will recognize that the flux direction depends on the winding direction of the primary and secondary coils). In this embodiment, the center portion 48 of the choke core 18 has twice the cross-sectional area of each of the outer portions 46 and 50. This allows for the desired flux density in the core 18, with all of the magnetic flux passing through the center portion 48, and half of the total flux density passing through each of the outer portions 46 and 50. The same is generally true for the transformer core 22, wherein the flux path for the primary winding may be that indicated by the dashed line B. Preferably, the holes 102*a*, 102*b* do not lay within the flux paths A, A'.

As noted earlier, a bobbin wound coil or otherwise insulated coil fits over the center portion of each core. Typically, a bobbin is constructed of plastic, and may be, for example, injection molded. The bobbin is sized to fit snugly about the center legs of the choke and transformer core, respectively, so as to minimize the distance between the windings and the center portion of each core. The small gaps which will necessarily exist between the two stacks 24*a*, 24*b* help to prevent the possibility of core saturation under DC conditions.

Figure 8:
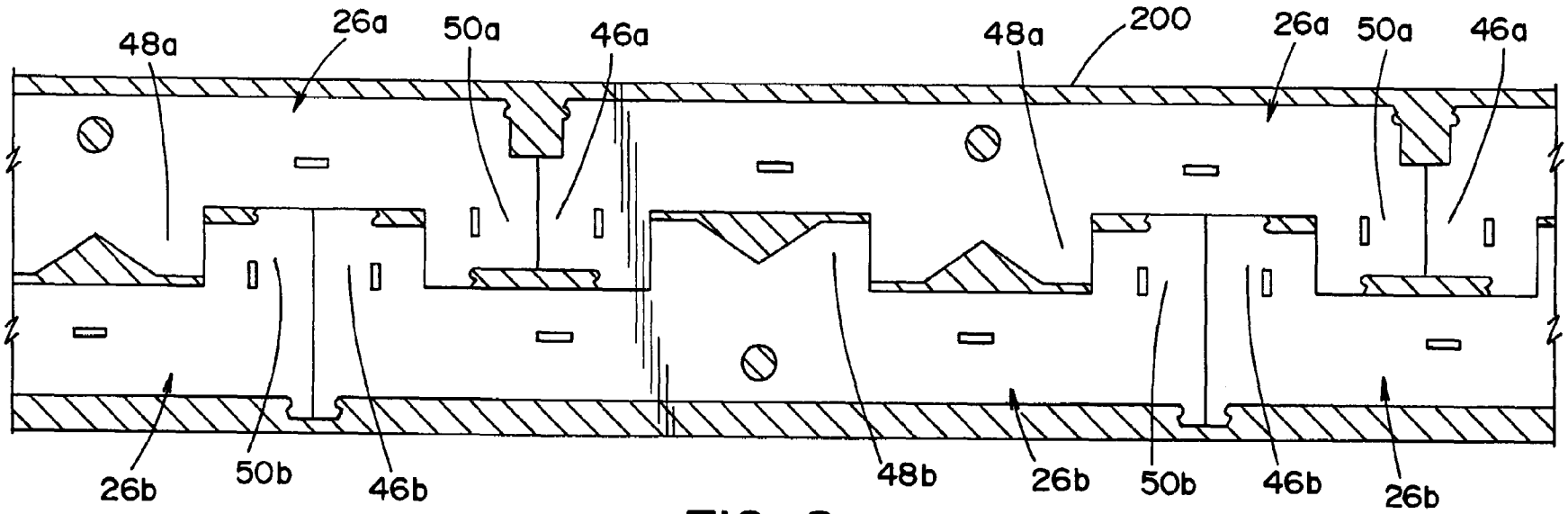
FIG. 8 is a partial top view of a sheet of lamination material showing the laminations to be punched or stamped from the material.

The upper and lower laminations 26*a*, 26*b* may be formed from a sheet 200 of lamination material, as in FIG. 8. The general outline of the lamination pieces 26*a*, 26*b*, which are punched or stamped in a single punching or stamping of the sheet 200 of material, is shown. It is seen that several "E" shaped upper laminations 26*a* and several "E" shaped lower laminations 26*b* are punched or stamped from the sheet 200 of material. The upper laminations 26*a* may be punched from the space between the outer legs 46*b*, 50*b* and the center leg 48*b* of two of the lower laminations 26*b*.

Figure 9:
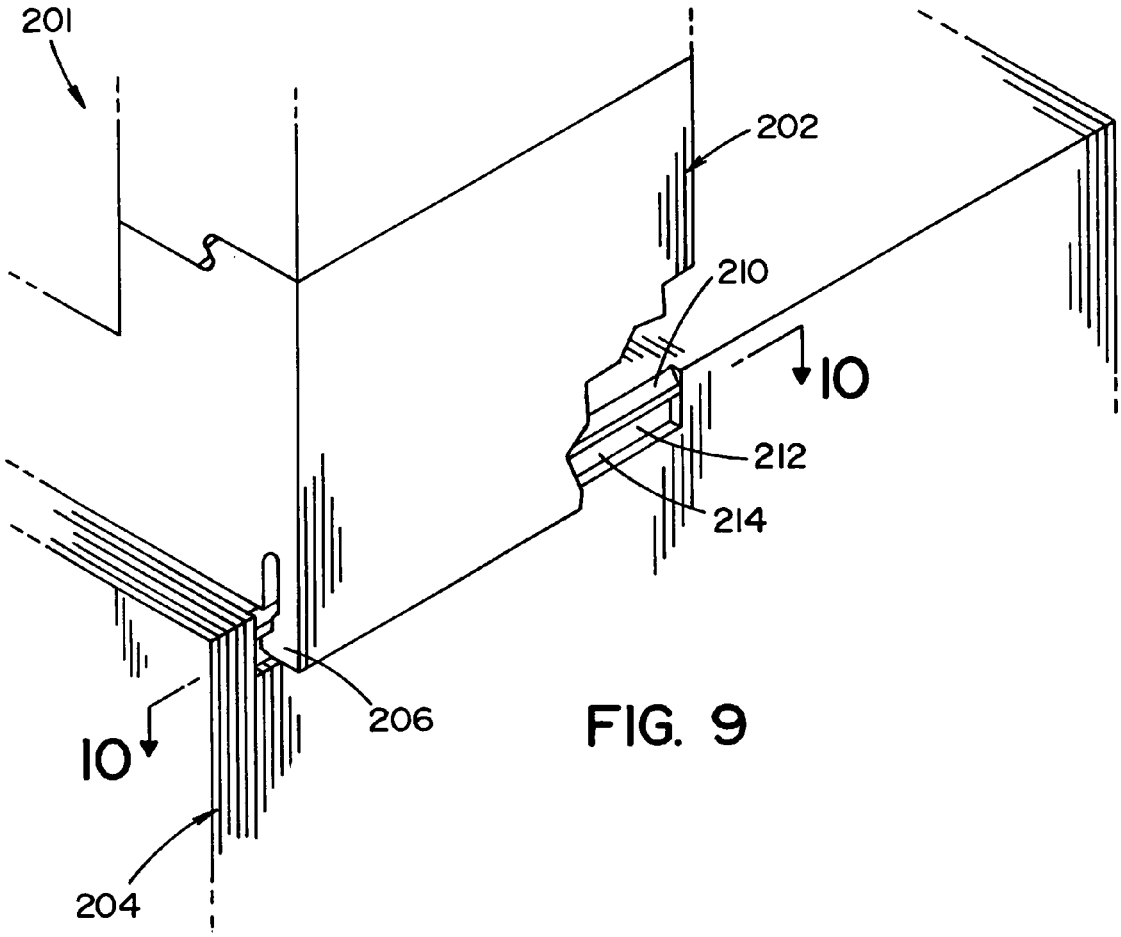
FIG. 9 is a partial perspective view showing an alternative embodiment of the choke and transformer assembly.
Figure 10:
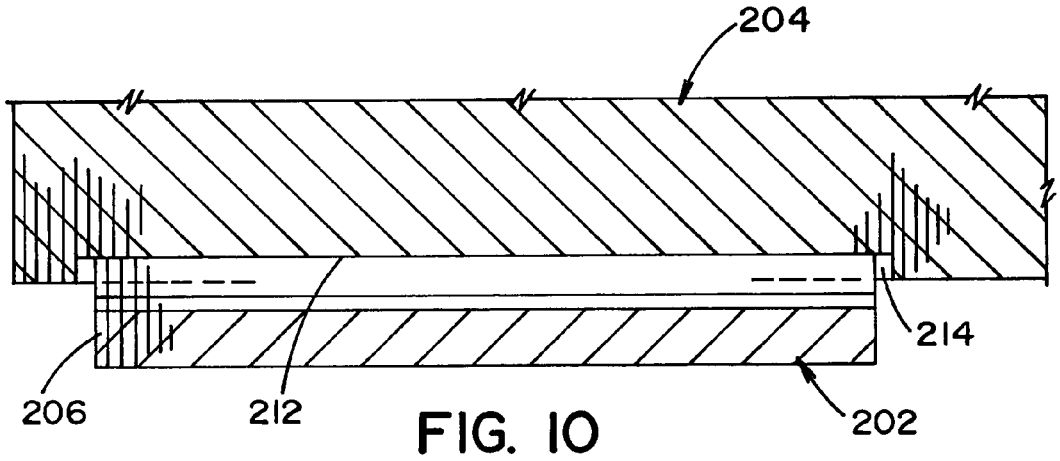
FIG. 10 is a partial cross-sectional view of the choke-to-transformer connection taken along the line 10-10 of FIG. 9.

FIGS. 9 to 11 show an alternative choke and transformer assembly 201 and, more particularly, the connection of the choke core 202 to the transformer core 204. The laminations in the choke core 202 include a slotted tab 206, which includes a camming surface 208. Some of the laminations in the transformer core 204 include a camming surface 210 and a slot 212. When these laminations are stacked together, a groove 214 is formed. By adjusting the number of laminations that include the camming surface 210 and the slot 212, the groove 214 may be "turned off and on" to provide automatic positioning of the choke core 202 onto the transformer core 204, as in FIG. 10.

Figure 11A:
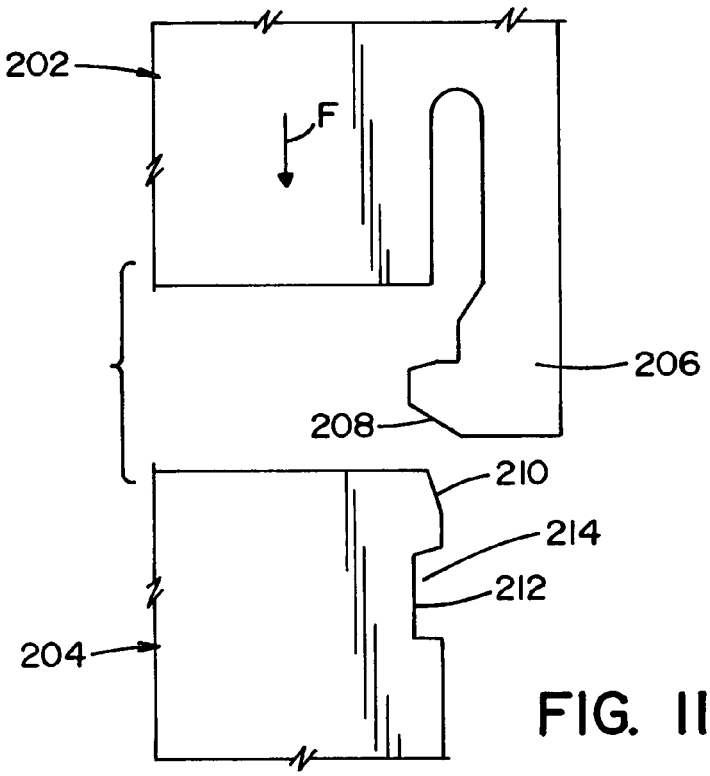
FIGS. 11A to 11C illustrate a detailed view of an alternative method of assembling stacks of laminations together.
Figure 11B:
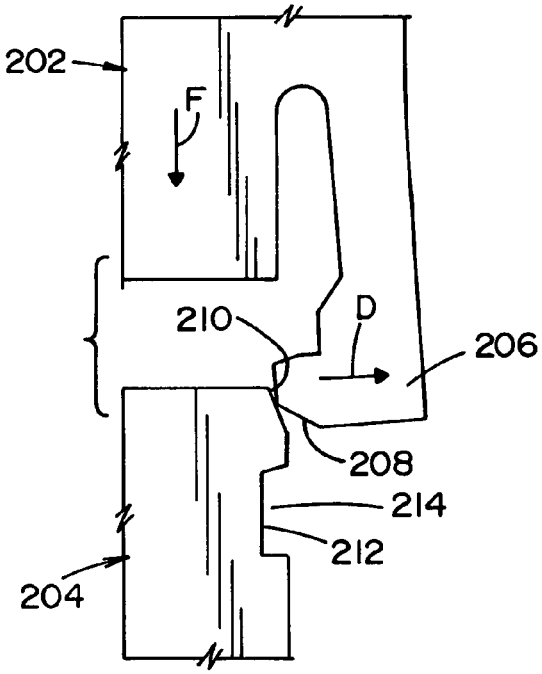
Figure 11C:
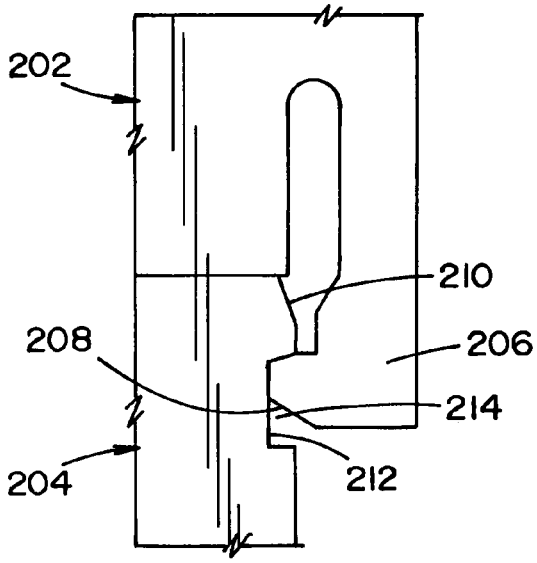

FIGS. 11A to 11C illustrate a method of assembling the choke and transformer core assemblies 202, 204 together. As a downward force F is exerted on the choke core 202, the camming surfaces 208 of the slotted tab 206 are forced against the camming surfaces 210. As a result of the camming action between the two camming surfaces 208, 210, the tab 206 moves in direction D. Finally, the ends of the tabs 206 sit securely in the groove 214 and the cores 202, 204 are locked in place. The camming action causes the cores 202 and 204 to mechanically engage each other in an interference fit, which locks them tightly together.

Figure 12:
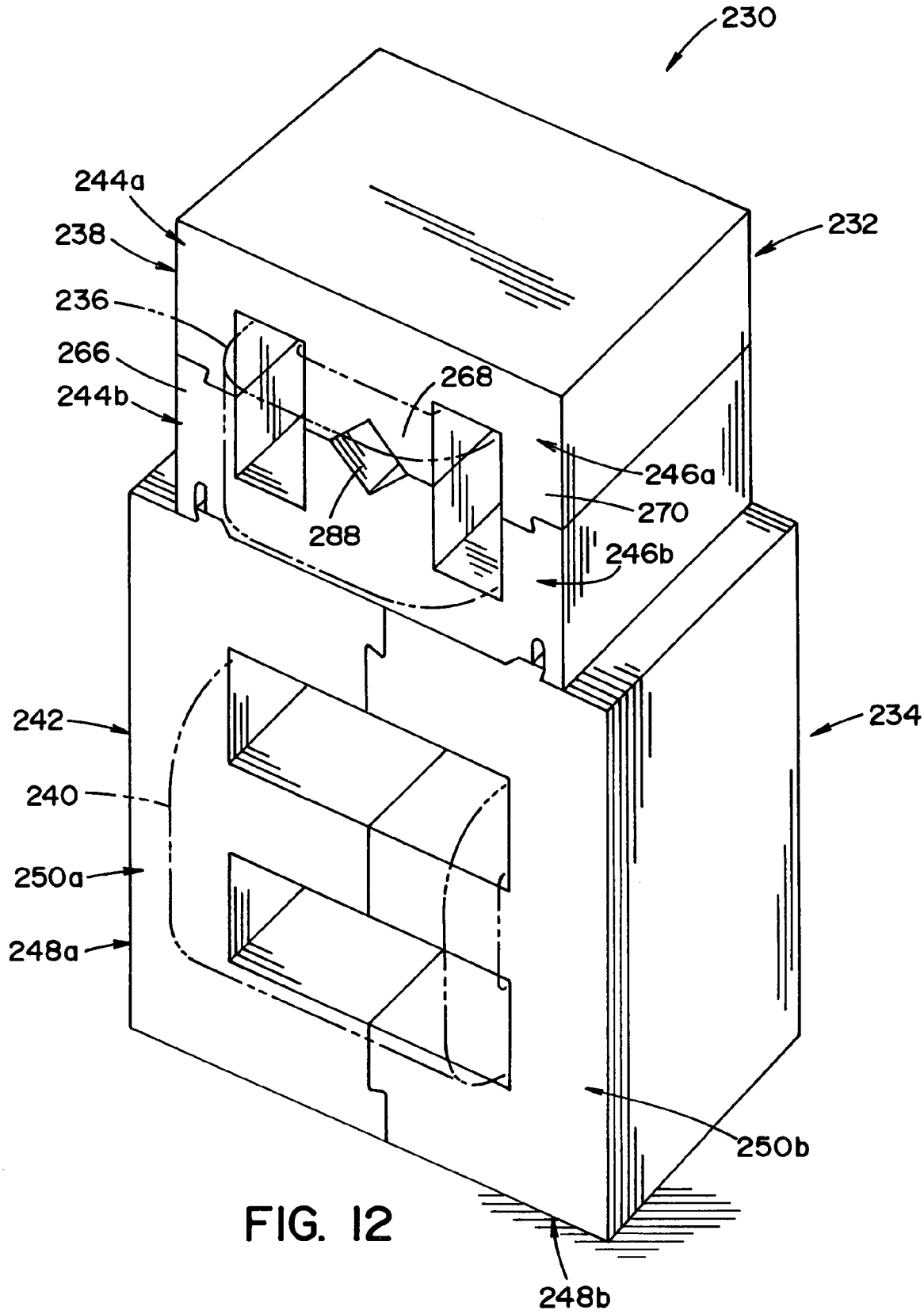
FIG. 12 is a perspective view of another embodiment of the choke and transformer assembly.
Figure 13:
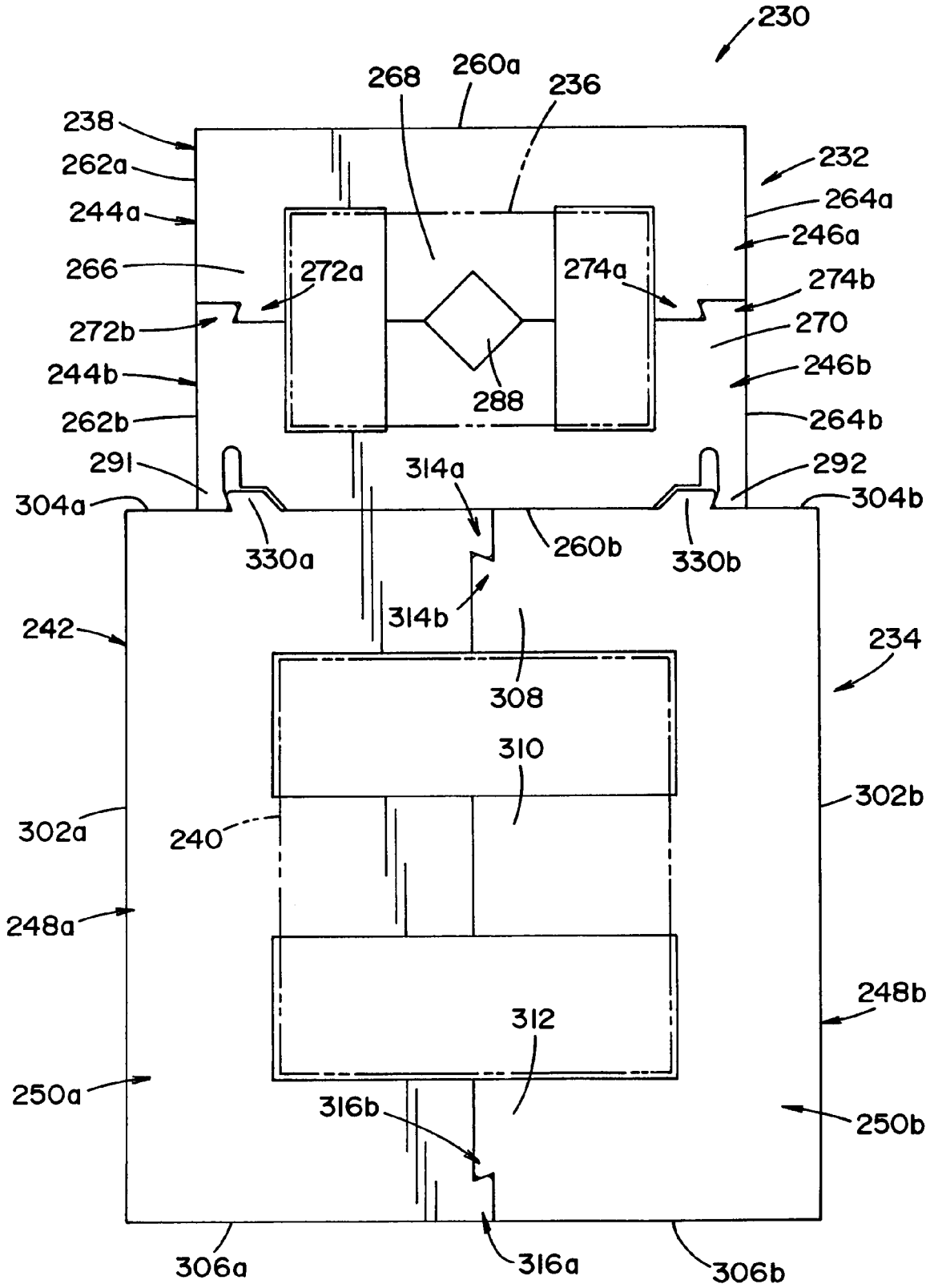
FIG. 13 is a front view of the choke and transformer assembly in FIG. 12.

FIGS. 12 and 13 illustrate another embodiment of a choke and transformer assembly 230 comprising a choke 232 and a transformer 234 constructed according to the teachings of the present invention. The choke 232 includes a coil 236 (shown in phantom lines) and a choke core assembly 238. The transformer 234 includes a coil 240 (shown in phantom lines) and a transformer core assembly 242. In this embodiment, the choke core assembly 238 is made up of an upper stack 244*a* of E-shaped laminations 246*a*, which are press-fitted into interlocking engagement with a complementary lower stack 244*b* of E-shaped laminations 246*b*, in accordance with the teachings of the present invention. Likewise, the transformer core assembly 242 is made up of a left stack 248*a* of E-shaped laminations 250*a*, which are press-fitted into interlocking engagement with a complementary right stack 248*b* of E-shaped laminations 250*b*. The choke 232 is press-fitted into interlocking engagement with the transformer 234 to form the choke and transformer assembly 230.

Figure 14:
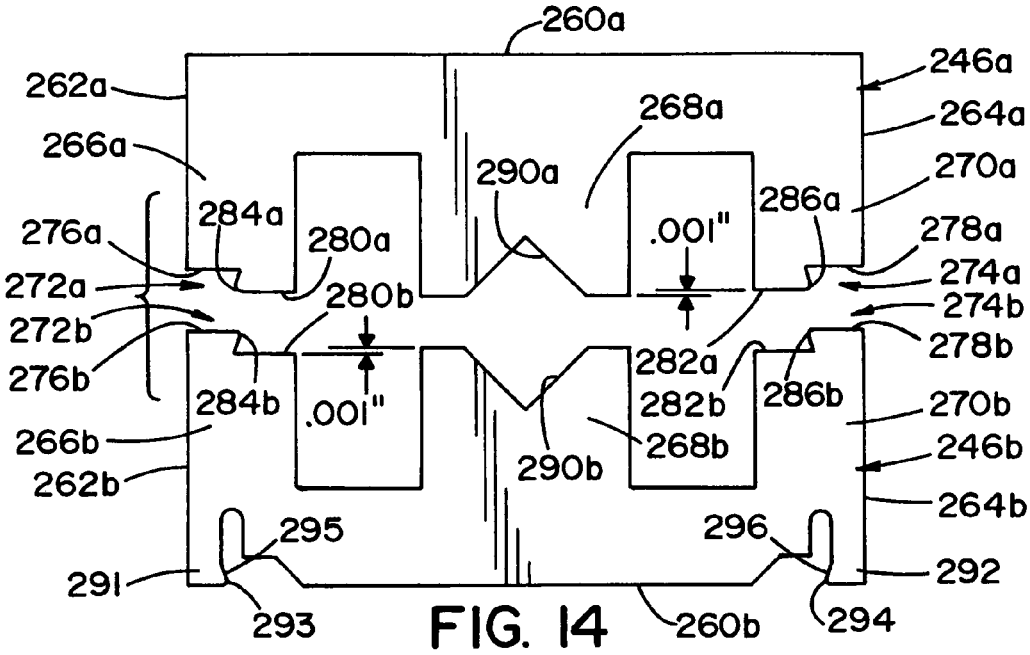
FIG. 14 is a front view, exploded, of the choke core of the assembly in FIG. 12.

As shown in FIG. 14, each upper "E" lamination 246*a* has a base portion 260*a* between a first side edge 262*a* and a second side edge 264*a* of the "E" formation. Extending from the base portion 260*a* is a first outer leg 266*a*, a center leg 268*a*, and a second outer leg 270*a*. As shown, the first and second outer legs 266*a* and 270*a* have end formations 272*a* and 274*a*, which are mirror images of each other (other configurations are possible) and include outer edge surfaces 276*a*, 278*a*, inner edge surfaces 280*a*, 282*a*, and connecting generally S-shaped surfaces 284*a*, 286*a*.

A diamond-shaped symmetrical air gap 288 is provided in the center legs 268*a*, 268*b*. Thus, the center leg 268*a* has a V-shaped cut-out 290*a*, which represents the top half of the air gap 288. Further, the center leg 268*a* is thicker than the outer legs 266*a*, 270*a*, although any desired width or thickness of the center leg 266*a* can be provided.

The lower "E" laminations 246*b* are substantially similar to the upper "E" laminations 246*a*. That is, each lower "E" lamination 246*b* includes a base portion 260*b* between a first side edge 262*b* and a second side edge 264*b* of the "E" formation. Extending from the base portion 260*b* is a first outer leg 266*b*, a center leg 268*b*, and a second outer leg 270*b*. The first and second outer legs 266*b* and 270*b* have end formations 272*b* and 274*b*, which are mirror images of each other and include outer edge surfaces 276*b*, 278*b*, inner edge surfaces 280*b*, 282*b*, and connecting generally S-shaped surfaces 284*b*, 286*b*. The center leg 268*b* has a V-shaped cut-out 290*b*, which represents the bottom half of the air gap 288. Further, the center leg 268*b* is thicker than the outer legs 266*b*, 270*b*.

In this embodiment, the lower "E" laminations 246*b* include a pair of slotted tabs 291, 292 in the outside corners for connecting the choke 232 to the transformer 234. The slotted tabs 291, 292 have rounded ends 293, 294 and angled surfaces 295, 296.

Figure 15:
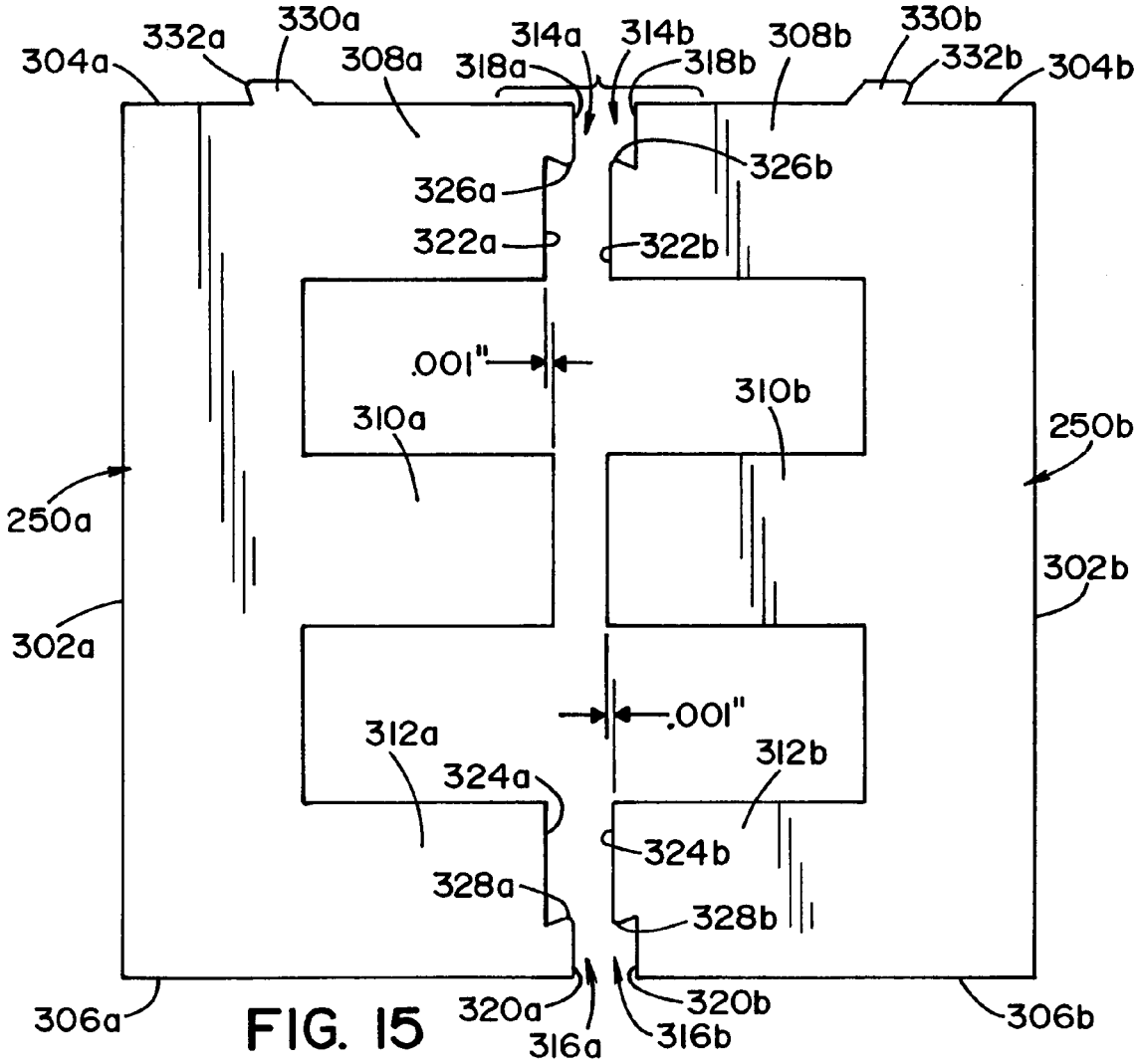
FIG. 15 is a front view, exploded, of the transformer core of the assembly in FIG. 12.

Turning now to FIG. 15, which shows the laminations of the transformer 234 in greater detail, each left "E" lamination 250*a* has a base portion 302*a* between a top edge 304*a* and a bottom edge 306*a* of the "E" formation. Extending from the base portion 302*a* is a first outer leg 308*a*, a center leg 310*a*, and a second outer leg 312*a*. As shown, the first and second outer legs 310*a* and 312*a* have end formations 314*a* and 316*a*, which are mirror images of each other and include outer edge surfaces 318*a*, 320*a*, inner edge surfaces 322*a*, 324*a*, and connecting generally S-shaped surfaces 326*a*, 328*a*.

The center leg 310*a* is generally thicker (or wider) than the outer legs 308*a*, 312*a*, although any desired width or thickness of the center leg 310*a* can be provided.

The right "E" laminations 250*b* are similar to the "E" laminations 250*a*. That is, each lamination 250*b* includes a base portion 302*b* between a top edge 304*b* and a bottom edge 306*b* of the "E" formation. Extending from the base portion 302*b* is a first outer leg 308*b*, a center leg 310*b*, and a second outer leg 312*b*. The first and second outer legs 308*b* and 312*b* have an end formation 314*b* and 316*b*, which are mirror images of each other and include outer edge surfaces 318*b*,

320*b*, inner edge surfaces 322*b*, 324*b*, and connecting generally "S" shaped surfaces 326*b*, 328*b*.

The laminations 250*a*, 250*b* include rigid tabs 330*a*, 330*b* on the top edges 304*a*, 304*b*. The tabs 330*a*, 330*b* include curved corner surfaces 332*a*, 332*b* on one side.

In this embodiment, the center portion 268 of the choke core 238 is pre-loaded. That is, the center legs 268*a*, 268*b* are approximately 0.001" longer than the first outer legs 266*a*, 266*b* and the second outer legs 270*a*, 270*b*, as best seen in FIG. 14. Likewise, the center legs 310*a*, 310*b* are approximately 0.001" longer than the first outer legs 308*a*, 308*b* and the second outer legs 312*a*, 312*b*. This helps make a tighter fit when the lamination stacks are assembled together.

Figure 16A:
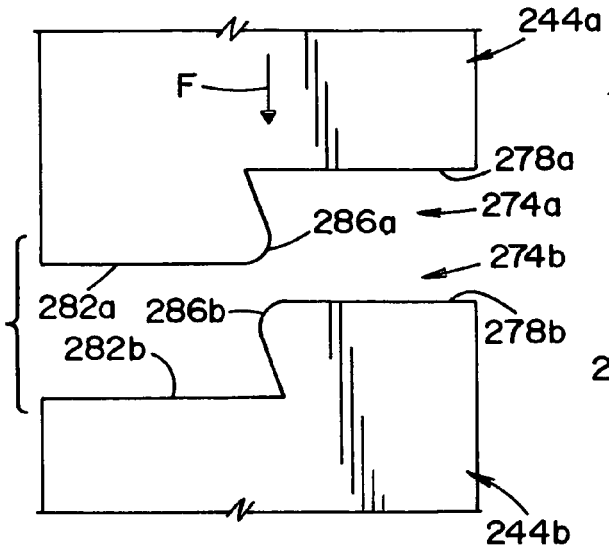
FIGS. 16A and 16B illustrate a detailed view of a method of assembling lamination stacks for the assembly in FIG. 12.
Figure 16B:
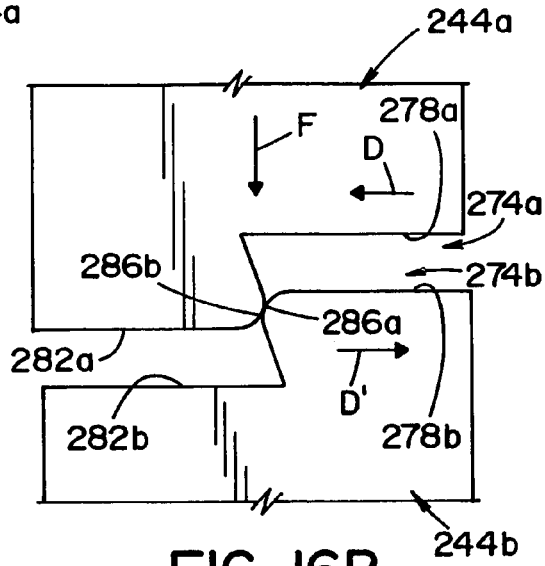

FIGS. 16A and 16B illustrate a method of assembling the stacks of laminations 244*a*, 244*b* together. By way of example, the connection of the complementary end configurations 274*a* and 274*b* are shown. As a downward force F is exerted on the upper stack 244*a*, the S-shaped surface 286*a* is forced against the S-shaped surface 286*b*. As a result of the camming action between the two surfaces 286*a*, 286*b* of the lamination stacks 244*a*, 244*b* move slightly in opposing directions D, D', respectively. Finally, the opposing surfaces of the upper and lower laminations meet, and the lamination stacks 244*a*, 244*b* are locked in place. The camming action causes the lamination stacks 244*a*, 244*b* to mechanically engage each other in an interference fit, which locks them tightly together. The lamination stacks 248*a*, 248*b* of the transformer core are assembled in a similar manner.

Figure 17A:
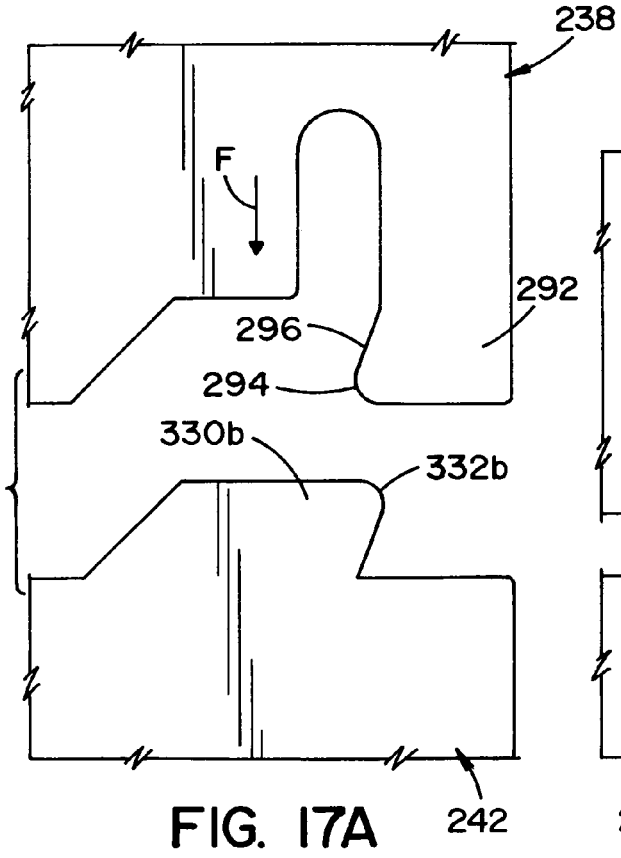
FIGS. 17A and 17B illustrate a detailed view of a method of assembling the choke and transformer assembly shown in FIG. 12.
Figure 17B:
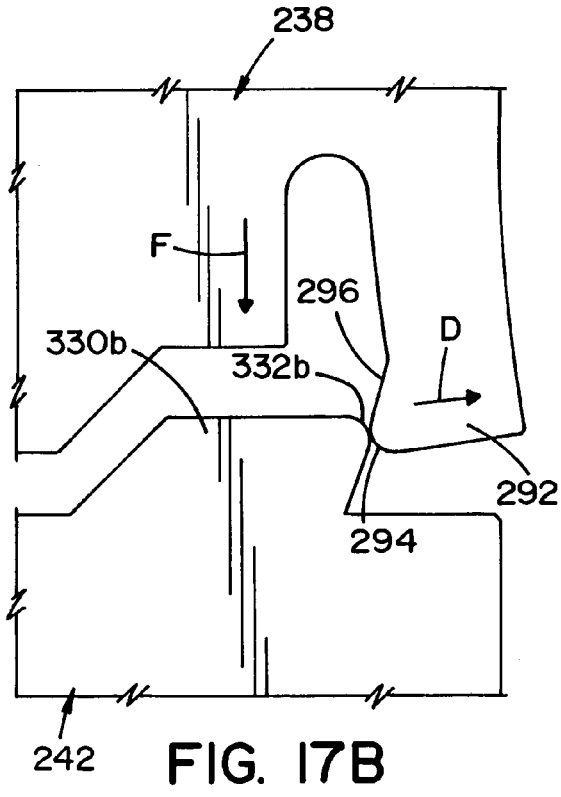

FIGS. 17A and 17B illustrate a method of assembling the choke and transformer core assemblies 238, 242 together. By way of example, the connection of the slotted tab 292 and the rigid tab 330*b* is shown. As a downward force F is exerted on the choke core 238, the curved surfaces 294 of the slotted tabs 292 are forced against the curved corner surfaces 332*b* of the rigid tabs 330*b*. As a result of the camming action between the two surfaces 294, 332*b*, the slotted tabs 292 move slightly in an outward direction D. Finally, the bottom portion of the choke core 238 and the top of the transformer core 242 meet, and the core assemblies 238, 242 are locked in place. The camming action causes the core assemblies 238 and 242 to mechanically engage each other in an interference fit, which locks them tightly together. In this embodiment, the laminations of the respective cores are stacked such that they run perpendicular to each other. Accordingly, connecting the choke to the transformer in this manner helps to strengthen the connection between the lamination stacks in the transformer.

Figure 18:
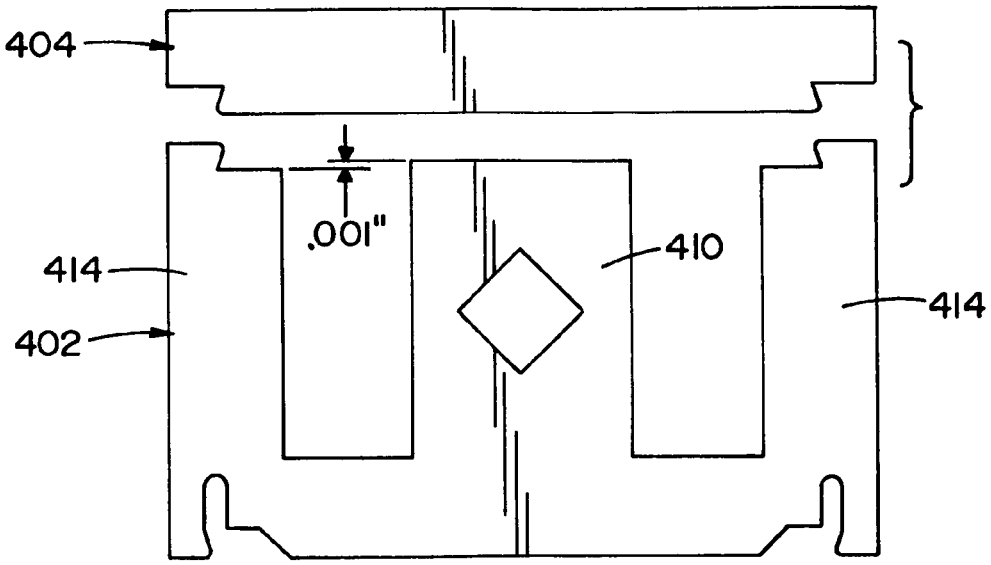
FIG. 18 is a front view, exploded, of laminations for an E-I choke core assembly according to the present invention.
Figure 19:
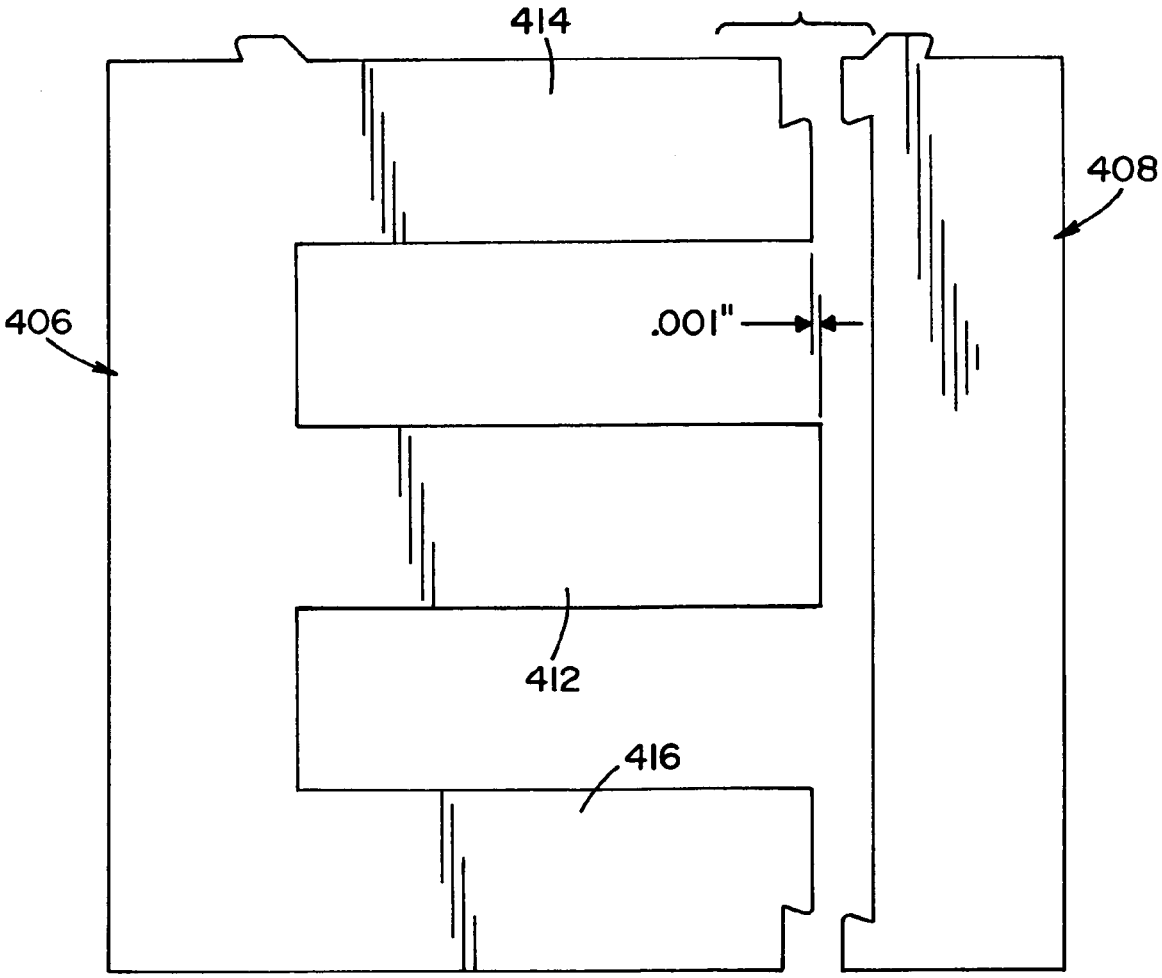
FIG. 19 is a front view, exploded, of laminations for an E-I transformer core assembly according to the present invention.

It is to be appreciated that E-I choke and transformer cores may be utilized in the present invention, as shown in FIGS. 18 and 19, for example. FIG. 18 illustrates an E-shaped lamination 402 and an I-shaped lamination 404, which may be connected or "snapped together" to form an E-I choke core as described earlier and as shown in FIGS. 16A and 16B. Likewise, FIG. 19 illustrates an E-shaped lamination 406 and an I-shaped lamination 408, which may be "snapped together" to form an E-I transformer core in a similar fashion. Further, the laminations 402, 406, and 408 include means for interconnecting the choke and transformer that are formed from the laminations 402, 404, 406, and 408, as shown in FIGS. 17A and 17B, for example. The cores may also be pre-loaded, wherein the center legs 410, 412 are approximately 0.001" longer than the outer legs 414, 416, respectively.

There is an enormous range of core materials that may be used, even within the same basic class. As known to those skilled in the art, the cores cannot be solid and electrically conductive, or excessive eddy current will flow, heating the cores and causing very high losses. Therefore, the cores generally use thin metal laminations, each electrically insulated from the next. Possible alloys include Silicon Steel, Cold Rolled Grain Oriented Silicon Steel (CRGO), and Cold Rolled Non Grain Oriented Silicon Steel (CRNGO).

It will also be apparent that modifications can be made to the laminations, the stacks formed therefrom and the choke and transformer core assemblies formed from the stacks without departing from the teachings of the present invention. For example, the assembly could include two chokes or two transformers. Accordingly the scope of the invention is only to be limited as necessitated by the accompanying claims.

What is claimed is:

1. An apparatus for an electric arc welder, comprising:

a first electromagnetic device including a first core assembly, wherein the first core assembly includes a first stack of laminations which are press-fitted into interlocking engagement with a complementary second stack of laminations so as to form two flux paths through the first core assembly, each of which passes through a center portion of the first core assembly, wherein the center portion of the first core assembly includes a diamond-shaped symmetrical air gap;

a second electromagnetic device including a second core assembly, wherein the second core assembly has a first stack laminations which are press-fitted into interlocking engagement with a complementary second stack of laminations so as to form two flux paths through the second core assembly, each of which passes through a center portion of the second core assembly; and interlocking engagement means for allowing the two core assemblies of the electromagnetic devices to be press-fitted into interlocking engagement with each other.

2. The apparatus defined in claim 1, wherein at least one of the first and second stacks of laminations in the first electromagnetic device includes E-shaped laminations.

3. The apparatus defined in claim 1, wherein at least one of the first and second stacks of laminations in the second electromagnetic device includes E-shaped laminations.

4. The apparatus defined in claim 1, wherein at least one of the first and second stacks of laminations in the first electromagnetic device includes I-shaped laminations.

5. The apparatus defined in claim 1, wherein at least one of the first and second stacks of laminations in the second electromagnetic device includes I-shaped laminations.

6. The apparatus defined in claim 1, wherein the first and second stacks of laminations in the first electromagnetic device are stacks of E-shaped laminations and the first and second stacks of laminations in the second electromagnetic device are stacks of E-shaped laminations.

7. The apparatus defined in claim 6, wherein each stack of laminations has a base portion extending between a first side edge and a second side edges and extending from each base portion is a first outer leg, a center leg and a second outer leg.

8. The apparatus defined in claim 7, wherein the first and second outer legs of each stack of laminations have end configurations which are mirror images of each other and facilitate an interfitting engagement of the two lamination stacks, each of the end configurations including an outer edge surfaces, an inner edge surface, a camming surface, and a notch.

9. The apparatus defined in claim 1, further comprising a first bobbin that is mountable on the center portion of the first core assembly, the primary winding of the first core assembly wound about the first bobbin;

a second bobbin that is mountable on the center portion of the second core assembly, the primary winding of the second core assembly wound about the first bobbin; and a secondary winding about the second bobbin.

10. The apparatus defined in claim 1, wherein two outer portions and the center portion of the first core assembly make up the flux paths through the first core assembly, and wherein the center portion of the first core assembly has a cross-sectional area that is substantially twice the cross-sectional area of either of the outer core portions.

11. The apparatus defined in claim 1, wherein the laminations in the first core assembly includes a plurality of metal displacements forming a rectangular depression on one side and a protuberance on the other side for facilitating joinder of the laminations.

12. The apparatus defined in claim 11, wherein the laminations in the second core assembly includes a plurality of metal displacements forming a rectangular depression on one side and a protuberance on the other side for facilitating joinder of the laminations.

13. An apparatus for an electric arc welder, comprising:

a first electromagnetic device including a first core assembly, wherein the first core assembly includes a first stack of laminations which are press-fitted into interlocking engagement with a complementary second stack of laminations so as to form two flux paths through the first core assembly, each of which passes through a center portion of the first core assembly, wherein the center portion of the first core assembly includes a diamond-shaped symmetrical air gap and the first stack of laminations in the first core assembly includes mounting means in each of the outside corners, each mounting means comprising a generally L-shaped cut-out having a side wall and a bottom wall, each side wall including a barb for biting into a plastic housing and securing the apparatus in the housing;

a second electromagnetic device including a second core assembly, wherein the second core assembly has a first stack laminations which are press-fitted into interlocking engagement with a complementary second stack of laminations so as to form two flux paths through the second core assembly, each of which passes through a center portion of the second core assembly, wherein the second stack of laminations in the second core assembly includes mounting means in each of the outside corners, each mounting means comprising a barb for biting into a plastic housing and securing the apparatus in the housing; and interlocking engagement means for allowing the two core assemblies of the electromagnetic devices to be press-fitted into interlocking engagement with each other.

14. An apparatus for an electric arc welder, comprising:

a choke including a first core assembly, wherein the first core assembly includes a first stack of laminations which are press-fitted into interlocking engagement with a complementary second stack of laminations so as to form two flux paths through the first core assembly, each of which passes through a center portion of the first core assembly, wherein the center portion of the first core assembly is pre-loaded and has a diamond-shaped symmetrical air gap; and a transformer including a second core assembly, wherein the second core assembly has a first stack laminations which are press-fitted into interlocking engagement with a complementary second stack of laminations so as to form two flux paths through the second core assembly, each of which passes through a center portion of the second core assembly, wherein the two core assemblies are press-fitted into interlocking engagement with each other, the center portion of the second core assembly is pre-loaded, and the choke is mounted on top of the transformer.

15. The apparatus of claim 14, wherein the first stack of laminations in the first core assembly of the choke includes mounting means in each of the outside corners, each mounting means comprising a generally L-shaped cut-out having a side wall and a bottom wall, each side wall including a barb for biting into a plastic housing and securing the apparatus in the housing and the second stack of laminations in the second core assembly of the transformer includes mounting means in each of the outside corners, each mounting means comprising a barb for biting into the plastic housing and securing the apparatus in the housing.

* * * * *

UNITED STATES PATENT AND TRADEMARK OFFICE

CERTIFICATE OF CORRECTION

PATENT NO. : 7,646,281 B2
APPLICATION NO. : 11/036455
DATED : January 12, 2010
INVENTOR(S) : Diekmann et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 424 days.

Signed and Sealed this

Sixteenth Day of November, 2010

David J. Kappos

David J. Kappos
*Director of the United States Patent and Trademark Office*